United States Patent [19]

Knoll

[11] 4,247,390

[45] Jan. 27, 1981

[54] METHOD OF SEPARATING VERMICULITE FROM THE ASSOCIATED GANGUE

[76] Inventor: Frank S. Knoll, 4120 Haines St., Jacksonville, Fla. 32206

[21] Appl. No.: 953,882

[22] Filed: Oct. 23, 1978

Related U.S. Application Data

[63] Continuation-in-part of Ser. No. 852,740, Nov. 18, 1977, abandoned.

[51] Int. Cl.[3] ..... B03C 7/00

[52] U.S. Cl. ..... 209/129

[58] Field of Search ..... 209/127–131, 209/9

[56] References Cited

U.S. PATENT DOCUMENTS

| | | | |
|---|---|---|---|
| 865,711 | 9/1907 | Kitsee | 209/129 |
| 1,744,967 | 1/1930 | Johnson | 209/131 |
| 2,445,227 | 7/1948 | Masse | 209/127 C |
| 2,559,076 | 7/1951 | Johnson | 209/127 A |
| 3,322,275 | 5/1967 | Breakiron | 209/127 R |
| 3,370,703 | 2/1968 | Carpenter | 209/127 R |
| 3,477,568 | 11/1969 | Madrid | 209/127 R |
| 3,897,330 | 7/1975 | Rhys | 209/128 X |
| 3,941,685 | 3/1976 | Sigewald | 209/127 R |
| 3,970,546 | 7/1976 | Webb | 209/128 X |

FOREIGN PATENT DOCUMENTS

| | | | |
|---|---|---|---|
| 278596 | 3/1927 | Fed. Rep. of Germany | 209/129 |
| 1034718 | 4/1953 | France | 209/127 R |
| 218354 | 7/1924 | United Kingdom | 209/129 |
| 662463 | 12/1951 | United Kingdom | 209/128 |
| 697932 | 9/1953 | United Kingdom | 209/127 R |
| 729934 | 5/1955 | United Kingdom | 209/129 B |
| 296591 | 5/1967 | U.S.S.R. | 209/131 |
| 325033 | 3/1972 | U.S.S.R. | 209/129 |
| 564883 | 10/1974 | U.S.S.R. | 209/127 R |
| 522858 | 8/1976 | U.S.S.R. | 209/127 R |

OTHER PUBLICATIONS

Electrostatic Sep. of Mixed Granular Solids, Ralston, 1961, pp. 136, 140, 141, pp. 70, 67.

Electrostatic Sep. of Granular Matls., Bulletin 603, Bu. of Mines, 1962, p. 96.

*Primary Examiner*—Robert Halper

*Attorney, Agent, or Firm*—Schuyler, Banner, Birch, McKie & Beckett

[57] ABSTRACT

A method of separating vermiculite from the associated gangue is disclosed in which the ore is fed to the top of a rotating support comprising a grounded conductive underlayer and a nonconductive overlayer and the ore particles are pinned to the rotating support by ion bombardment. The gangue tends to separate first from the roll while the vermiculite particles have a greater tendency to remain pinned to the roll and can be collected as a separate fraction.

30 Claims, 2 Drawing Figures

1
2
3
4
5
6
7
8
9
10
11
12
14
15
16
17
18
19
20
21
β
α

METHOD OF SEPARATING VERMICULITE FROM THE ASSOCIATED GANGUE

CROSS-REFERENCE TO RELATED APPLICATIONS

This application is a continuation-in-part of my copending application Ser. No. 852,740 filed Nov. 18, 1977, now abandoned.

BACKGROUND OF THE INVENTION

High tension separation is a well established technique for classifying particulate materials such as mineral ores, shredded refuse, seeds and the like. In conventional practice separation is effected according to the electrical conductivities of the constituents of the particulate mixture. Usually, particles are fed to the top of a rotating, grounded, conductive roll or drum and are bombarded with ions from a corona discharge electrode to charge the particles on the roll surface so that they will adhere to the surface of the roll. The more conductive particles tend to lose their charge rapidly by conduction and soon separate from the roll under the influence of centrifugal force and the force of gravity. Less conductive particles tend to retain their charge and remain pinned to the roll for a longer period of time so that they can be collected as a separate fraction. Generally, the charged particles are subjected to a static field which assists in drawing away the conductive particles while holding the nonconductive particles to the rotating conductive roll.

Examples of such systems are disclosed in Grave, U.S. Pat. No. 2,072,501; Hewitt, U.S. Pat. No. 2,314,940; Johnson, U.S. Pat. No. 2,687,803; Roberts, U.S. Pat. No. 2,737,348; Breakiron, U.S. Pat. No. 3,322,275; and Barthelemy, U.S. Pat. No. 3,308,948. A modified system in which the grounded conductive roll is comprised of alternating disks of conductive and nonconductive material is disclosed in Payne, U.S. Pat. No. 994,870. Another modified system in which the roll is provided with a surface layer of highly resistive or semiconductive metal oxide is described in Fraas, U.S. Pat. No. 3,012,668. All of these systems depend on differences in the conductivities of the different materials to achieve separation.

British Pat. No. 662,463 discloses treating the surfaces of a mixture of diamond particles and gangue with an electrolyte solution and then subjecting the treated ore to conventional type separation in order to remove the diamonds from the rock or sand with which they are associated based on the differences in conductivity. Also discussed is a procedure for classifying the separated diamonds in which the diamond concentrate is fed over a metallic or nonmetallic belt past an ionizing electrode and predominantly round and predominantly flat diamond fractions are caused to separate from the belt.

When attempts are made to apply conventional electrostatic or high tension techniques to the treatment of vermiculite ores in order to separate the vermiculite from its associated gangue, satisfactory results are not obtained. Conventional electrostatic techniques can sometimes be utilized to separate vermiculite from gangue at particle sizes less than about 6 mm in size, but as the particle size increases, it becomes impossible with prior art methods and equipment to effectively separate the vermiculite particles from the associated gangue. The electrical resistivity of vermiculite ranges from about $2\times10^9$ to about $70\times10^9$ ohms/cm while the resistivity of the stone in a typical vermiculite gangue ranges from about $150\times10^9$ to about $800\times10^9$ ohms/cm. Such a difference is simply too small for effective separation by conventional electrostatic techniques. Similar problems occur in separating mica from its ore.

Conventional electrostatic or high tension separations also require drying of the material being processed prior to feeding it to the separator. Ordinarily, moisture levels must be reduced to about two percent or less for conventional techniques to be effective. It will be appreciated that the need for such drying introduces undesirable expense and inconvenience into the separation process.

Although it is not possible to effectively separate vermiculite from the associated gangue utilizing conventional high tension separation techniques which depend on differences in conductivity, it has been discovered that high tension can be utilized to separate vermiculite from its gangue if the separator roll is covered with a layer of nonconducting resin. This achievement is based on the discovery that the vermiculite particles and the gangue particles in the ore tend to have different characteristic particle shapes. The vermiculite tends to take the form of comparatively flat crystalline particles. The gangue tends to have a more nearly spherical particle shape. By treating the ore with a separator having a nonconductive layer over the separator drum, it is possible to separate the vermiculite and the gangue based on their characteristic particle shapes. Moreover, drying of the ore is not necessary. Moisture contents of up to about twenty percent by weight do not prevent effective separations.

OBJECTS OF THE INVENTION

Accordingly, it is an object of the present invention to provide a method for separating comparatively flat crystalline mineral such as vermiculite or mica from an ore mixture.

It is also an object of the present invention to provide a method for separating vermiculite or mica from its associated gangue which does not depend on differences in electrical conductivities to effect the separation.

It is a further object of the present invention to provide a high tension method for separating vermiculite from associated gangue.

Another object of the invention is to provide a method for separating a flat crystalline mineral material from the associated gangue which does not require drying the ore.

A further object of the invention is to provide a method for separating vermiculite from moist ore.

It is also an object of the present invention to provide a method for separating relatively flat crystalline mineral particles from an ore mixture having a particle size greater than about 6 mm.

One more object of the present invention is to provide a method for separating a relatively flat crystalline mineral from its ore in which the size of the apparatus utilized is appropriately matched to the size of the ore particles.

SUMMARY OF THE INVENTION

These and other objects of the invention are achieved by providing a method for separating relatively flat crystalline mineral particles from an ore comprising the steps of feeding the ore mixture to a rotating support comprising a grounded, conductive underlayer and a nonconductive overlayer; pinning the ore particles to the rotating support by bombarding the particles on the support in a first zone along the path of rotation with ions from at least one ionizing electrode; and collecting a first fraction comparatively poor in the desired mineral and a second fraction comparatively rich in the desired mineral in second and third zones respectively along the path of rotation of the support as the ore particles separate from the rotating support.

BRIEF DESCRIPTION OF THE DRAWINGS

The invention will be described in greater detail with respect to the accompanying drawings wherein.

DETAILED DESCRIPTION OF THE PREFERRED EMBODIMENTS

Figure 1:
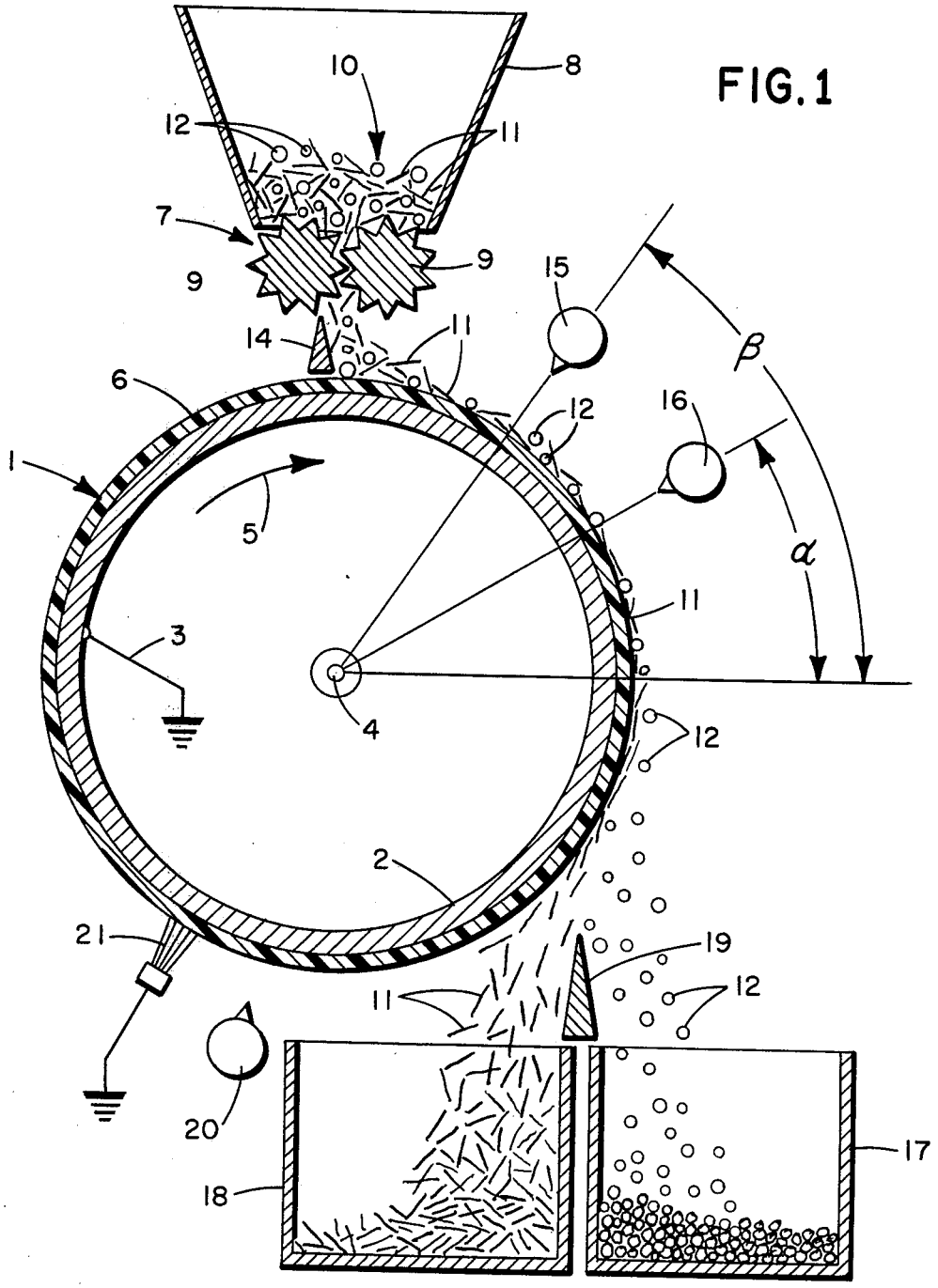
FIG. 1 is a schematic representation of apparatus for effecting mineral ore separation according to the method of the present invention.

FIG. 1 shows a high tension separator 1 comprising a conductive steel roll 2 which is grounded as shown at 3. Roll 2 is mounted for rotation about a horizontal axis 4 in the direction indicated by arrow 5. Roll 2 may range in size from 200 to 1500 mm in diameter and may suitably be driven at speeds ranging from 2 to 100, preferably 5 to 75, most preferably 8 to 50 r.p.m. Roll 2 is provided with a nonconductive overlayer 6. Layer 6 may be a resinous synthetic polymer having insulating properties such as polyethylene, polypropylene or various polyurethanes. A particularly preferred material is chloro sulfonate polyethylene. Film-forming polyurethanes which are coated on the drum in solvent medium after which the solvent is evaporated to deposit a uniform insulating film extending over the drum surface are also very suitable. Other suitable materials include natural and synthetic rubber, extruded coatings of unsubstituted or halogenated thermoplastic polyolefins, (e.g., polytetrafluoroethylene), polyamides (e.g., polycaprolactam, polyhexamethylene adipamide), polycarbonates, polyesters (e.g., polyethylene terephthalate), phenolics (e.g., phenol formaldehyde) or any other insulating resinous material. Ceramic coatings may also be utilized. It is preferred that the nonconductive overlayer have a thickness of at least 0.25 mm up to 25.0 mm, preferably from 1.25 mm to 4.0 mm, and a volume resistivity in excess of $10^{-1}$ ohm/cm, preferably greater than $10^{8}$ ohm/cm, most preferably from $10^{10}$ to $10^{17}$ ohm/cm, although insulating resin coatings having other values may be useful in certain applications.

An ore feeding device 7 comprising a hopper 8 and a pair of spline feeder roll 9 is positioned above roll 2 so as to deposit the ore at the top of the roll. The ore comprises a mixture 10 of vermiculite particles 11 and gangue particles 12. Preferably the ore is deposited either substantially directly above the axis about which the roll rotates or slightly forward thereof in the direction in which the top of the roll moves so that the ore particles will not slide down the back of the roll. A stationary blocking bar or am 14 may be provided at the top of the roll to prevent the ore particles from sliding down the back of the roll. After they are deposited on the roll the ore particles are carried along with roll 2 as it rotates.

Desirably, the ore particles will have a minimum size of at least 6 mm. Maximum particle size may range up to 50 mm or more depending on the materials and the parameters of operation. Preferably, the ratio of the maximum particle size to minimum size will not exceed about 5 to 1. For example, excllent separation of vermiculite ores can be achieved when the ore has been screened so that the size of the particles varies from 6.7 to 25 mm. Generally, the larger the particles, the slower the rate of rotation of the support electrode should be.

The moisture content of the vermiculite ore may range up to about twenty percent by weight. This is a distinct contrast to conventional electrostatic or high tension separations where the moisture content of the material must be reduced to as low a value as possible, usually about two weight percent or less. For ease in handling it is preferred that the moisture content of vermiculite ore treated according to the present invention be in the range from one-half to eight percent.

The ore particles on the roll are bombarded with ions from an ion source such as D.C. corona discharge electrode 15. As the structure of such electrodes is well known in the art, it will not be described here in detail. Electrode 15 is connected to a source of D.C. potential ranging up to 45 or 50 kilovolts, preferably between 15 and 40 kilovolts and most preferably between 20 and 35 kilovolts. Filtered or unfiltered direct current produced by rectifying conventional 50/60 cycle alternating line current has been found to be suitable. The polarity of electrode 15 may be either positive or negative. Electrode 15 ionizes molecules of the surrounding air and directs a beam of such ions against the ore particles 10 on the surface of drum 2. This results in the particles acquiring a charge having the same polarity as electrode 15.

Although the method of the invention may be denominated an "electrostatic" separation, the method is not electrostatic in the strictest sense of the term because there is some flow of current from the corona electrodes to the particles on the rotating support. Typical current flow will range from 0.2 to 10 milliamperes per meter of electrode length. The charged particulate material adheres to the surface of the rotating roll and in the vernacular of the art is said to be "pinned" to the roll.

If desired, one or more additional corona electrodes such as second D.C. corona electrode 16 may be provided adjacent electrode 15 to assure that a uniform charge is deposited on the particles upon the drum surface. Generally, the number of corona electrodes will be related to the diameter of the rotating support electrode; the larger the diameter, the greater the number of electrodes. Electrode 16 should have the same polarity as electrode 15 and desirably is similar in structure and has the same or higher potential than electrode 15.

Because of the nonconductive overlayer 6 on drum 2, the charge on the particles does not dissipate regardless of the conductivity of the particles, but instead the charge is retained on the surface of the particles. The density of the charge applied to the particles depends upon the potential of the electrodes and the length of time to which the particles are exposed to ion bombardment. The total charge accumulated by any given particle varies with the size of the exposed surface area; the larger the available area, the greater the total charge accumulated. The charge causes the particles to tend to adhere to the rotating support.

The use of a rotating support electrode comprising a grounded conductive underlayer and a nonconductive overlayer makes it possible to develop a difference in potential between the inner and outer surfaces of the rotating support so that the charged ore particles will adhere to the rotating support. The scope of the terms "conductive underlayer" and "nonconductive overlayer" is not intended to be limited to devices comprising distinct, discrete layers but is intended to embrace functional equivalents such as cast drums of nonconductive polymeric material in which the material adjacent the inner surface of the drum has been modified by incorporating particles of conductive material such as silver, nickel or carbon black therein.

Without being bound to any particular theory, it is believed that the charged ore particles on the surface of the rotating support and the grounded conductive underlayer tend to act like the plates of a capacitor separated by the nonconductive overlayer; that the charge on the ore particles tends to induce a charge of opposite polarity in the grounded conductive underlayer of roll 2; and that it is the interaction between these two opposite charges which is largely responsible for the adhesion of the ore particles to the drum. The strength of the forces holding each particle to the drum depends on the magnitude of the charge on the particle and the proximity of the particle charge to the induced charge on the grounded conductive underlayer on the other side of the insulating layer from the charged particles. Consequently, a relatively flat particle with a large exposed surface area which sits comparatively tightly against the surface of the roll will be held most strongly to the roll.

In contrast thereto the forces tending to cause the ore particles to separate from the roll are (1) the centrifugal force resulting from the rotation of the roll and (2) the force of gravity which effectively increases as the particles pass from the top of the roll where their weight is wholly or partially supported by the roll to the underside of the roll where their weight is not supported at all by the roll. Both the magnitude of the centrifugal force and the magnitude of the gravitational force acting on the ore particles depends on the mass of the particle. The greater the mass of the particle, the greater the force tending to cause the particle to separate from the roll.

In view of the foregoing considerations, it is apparent that comparatively flat vermiculite particles with a high surface area to mass ratio will be subject to stronger forces tending to hold them against the roll and lesser forces tending to pull them away from the roll while the spherical or more nearly spherical gangue particles having a lower surface area to mass ratio will be subject to lesser forces tending to hold them against the roll and stronger forces tending to cause them to separate. Consequently, the flatter vermiculite particles can be separated from the more spherical gangue partilces.

It is understood that the term flat particles is not intended to be limited to particles which are absolutely flat. Likewise, the term spherical particles is not intended to be limited to particles which are perfectly spherical. Instead, these terms are intended to represent limiting cases in which the surface area to mass ratio of a particle of any given material will achieve maximum and minimum values respectively. In actual practice, it is understood that the ore particles in all probability will be neither absolutely flat nor perfectly spherical but that the average particle shape of the vermiculite particles will be more nearly flat; that is, have a higher surface area to mass ratio than the average particle shape of the gangue particles which is more nearly spherical; that is, has a lower surface area to mass ratio.

The flatness of particles may be compared by computing a flatness coefficient for a typical or average particle of each material and then computing the ratio of the two coefficients. The flatness coefficient for a typical particle is determined by considering the particle resting upon a horizontal surface in the most stable position. The maximum dimension of the particle in the direction parallel to the surface upon which it is resting is taken as the particle length L. The maximum dimension of the particle in the direction perpendicular to the surface upon which it rests is taken as the particle thickness T. The flatness coefficient C is determined by dividing the length L by the thickness T. The greater the numerical value of the coefficient, the flatter the particle. The flatness ratio of two different materials in a particle mixture is determined by dividing the larger coefficient by the smaller coefficient (for a typical particle). Generally effective separations on the basis of particle shape can be carried out if the ratio of the flatness coefficients of typical particles of the materials in the mixture is greater than or equal to 2. Increasing efficiency may ordinarily be expected when the flatness ratio assumes larger numerical values. If the value of the flatness ratio is comparatively low, repeated passes through the separator may be desirable to increase the overall efficiency of the separation.

The speed of rotation of the roll affects both the magnitude of charge applied to the ore particles by controlling the length of time which they are exposed to ion bombardment and also controls the amount of centrifugal force acting on the particles. Lower speeds subject the particles to ion bombardment for a greater period of time so that the magnitude of the charge accumulating on the particle surfaces is larger and the electrostatic forces holding the particles to the roll are greater. Higher roll speeds increase the centrifugal forces which tend to cause the particles to separate from the roll. The amount of charge accumulated on the particles also depends on the intensity of the ion beams which in turn is controlled by the potential of the electrodes. By appropriately adjusting the speed of the roll as well as the potential of the ionizing electrodes, it is possible to adjust the operating conditions of the method so that particles of one given surface area to mass ratio will separate from the roll while particles of a slightly higher surface area to mass ratio are retained on the roll.

Thus it is that the spherical or more nearly spherical gangue particles 12 separate from the rotating roll and fall into container 17 which the flat or more nearly flat vermiculite particles 11 tend to be retained on the roll and are deposited in container 18. A splitter 19 is provided adjacent the roll between containers 17 and 18 to deflect gangue particles into bin 17. The splitter spacing, or distance between the top of the splitter and the rotating support, may range between 10 and 50 mm and the angular position of the splitter is suitably between 30 and 60 degrees, preferably between 30 and 45 degrees below the horizontal axis of the roll.

The position of each of the ionizing electrodes is defined by the distance between the electrode and the surface of the roll and by the angle between a line joining the electrode and the center of the roll with a horizontal line through the center of the roll. In general, effective shape separations can be achieved when the electrode spacing ranges between 50 and 120 mm and the electrodes are located between 10° and 80° above horizontal. In the illustrated embodiment, two electrodes 15 and 16 are shown. In the drawing, the angular position of electrode 15 is indicated as angle beta and the angular position of electrode 16 as angle alpha. Preferably, beta will range between 40° and 80° and alpha between 10° and 60°.

It is highly desirable that the diameter of the rotating support electrode by appropriately related to the size of the ore particles being separated in order to maximize the contact between the surface of the rotating electrode and the relatively flat crystalline mineral particles. Large roll diameters are more favorable when the size of the particles, particularly the relatively flat ones, is larger because the larger circumference presents a flatter roll surface which mates better with the flat particles thereby enhancing the electrical interaction which is believed to cause the particles to adhere to the roll.

Consequently, the diameter of the rotating support electrode should increase as the size of the flat crystalline mineral particles increases. it is preferred that the diameter of the rotating support be at least about 10 times the maximum particle size of the ore particles. Most preferably, the diameter of the rotating electrode will range from 20 to 25 times the size of the largest ore particles. Thus is has been found that when the nominal size of the vermiculite particles ranges up to 25 mm, shape separation can be carried out effectively using drum electrodes from 250 to 500 mm in diameter. When the size of the particles ranges up to 50 mm, better separation response is obtained with rolls ranging from 450 to 1250 mm or more in diameter.

The rate at which the ore can be fed to the separator depends on the size of the ore particles. Generally, the larger the size of the ore particles, the greater the permissible rate of feed. Feed rates ranging from 30 to 150 pounds per hour per inch of roll length in the axial direction have been found acceptable. It is preferred that the rate of feed range between about 50 and about 90 pounds per hour per inch of roll length.

Various types of mechanisms may be utilized to feed the ore particles to the separator including gravity gate hoppers, conveyor belts, star spline feeders, vibratory feeders and electrostatic feeders. Conveyor systems and vibratory feeders are preferred for coarse ores while electrostatic feeders are more suitable for finer ores.

Inasmuch as roll 2 is provided with a nonconductive outerlayer 6, charges applied to the surface of the roll from ionizing electrodes 15 and 16 tend to remain on the surface of the roll, and vermiculite particles sometimes adhere to the roll past the intended point of discharge. It is generally desirable to bleed off such residual charges and remove adhering particles before the roll makes a complete revolution so that ore particles from the feeding mechanism are not deposited on a charged surface or on top of vermiculite particles. For this purpose, separator 1 is provided with a wiper electrode 20 which acts to partially neutralize or level out residual charges on the surface of the roll. Either an A.C. electrode or a D.C. electrode may be uitlized although a D.C. electrode is preferred. From 5 to 30 kilovolts potential may be applied to the wiper electrode 20. Preferably, the potential applied to the wiper electrode will range between 10 and 15 kilovolts.

A brush 21, which may be either rotating or stationary, is provided to assist in removing any remaining particles from the rotating support electrode. If desired, brush 21 may be made of electrically conductive material and grounded to assist in removing residual charges from the roll surface.

The simplest treatment scheme fo practicing the method of the present invention is to pass an ore mixture once through a high tension separator having a rotating roll with a nonconductive layer, as described above.

Figure 2:
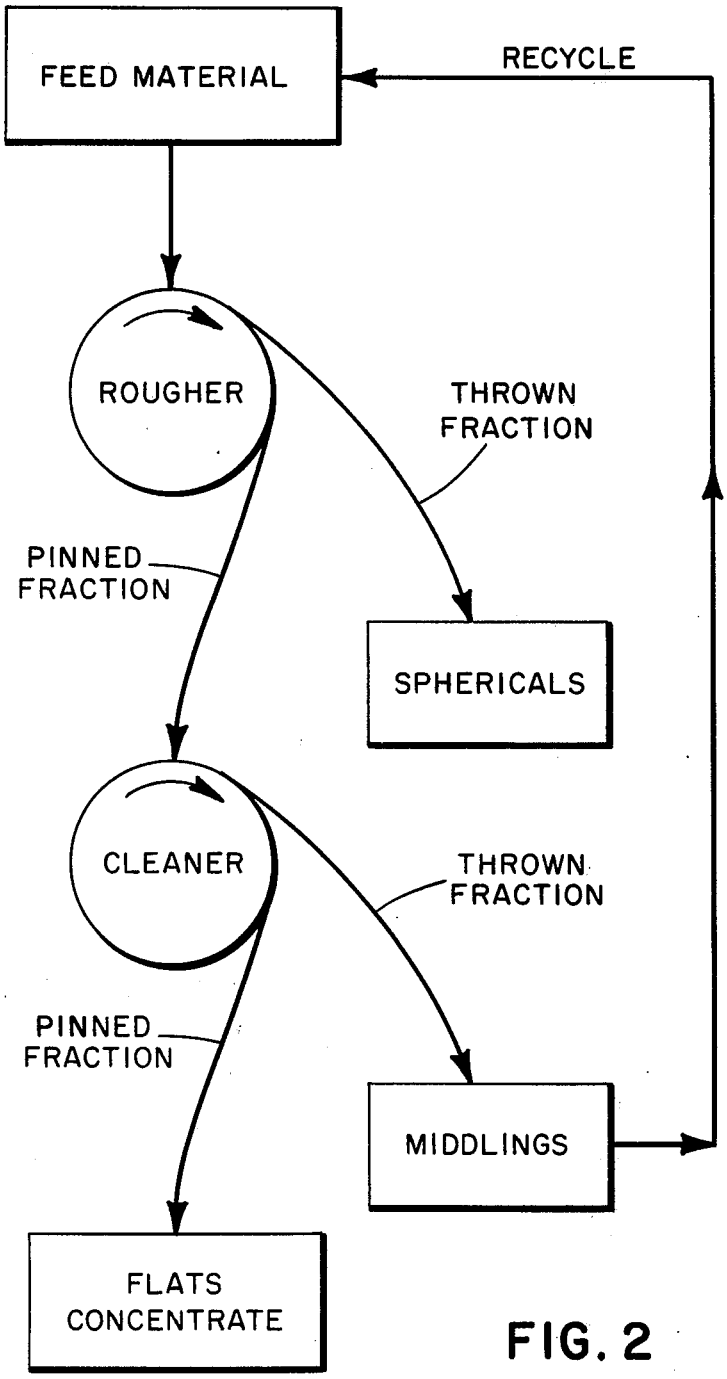
FIG. 2 is a schematic representation of a two-stage treatment scheme for carrying out the method of the present invention.

FIG. 2 depicts a slightly more complicated treatment scheme designed to isolate a high purity vermiculite concentrate. Raw ore is first fed to a rougher separator where most of the more spherical gangue particles are separated in the thrown fraction while the majority of the relatively flat vermiculite particles and a small portion of the more spherical gangue material are retained in the pinned fraction. The pinned fraction from the rougher stage is then passed to a cleaner separator where substantially all of the remaining gangue particles are separated in the thrown material to produce a middlings fraction which can be recycled to the feed material. The majority of the relatively flat vermiculite particles are collected in the pinned fraction of the cleaner stage to produce a high grade vermiculite concentrate.

The method of the invention is highly energy efficient. Vermiculite is conventionally separated from its associated gangue by sizing and air classification techniques. Over 4 horsepower per ton per hour are required to operate a processing plant utilizing such techniques. In contrast thereto a processing plant utilizing the method of the present invention can be operated with less than one horsepower per ton per hour.

The method of the invention has some unusual and surprising aspects. Prior workers who have attempted to utilize conventional high tension separation have reported limited success at small particle sizes, but have indicated that large particle sizes greater than 6 mm could not be separated. Conventional high tension separation based on conductivity differences is more efficient at small particle sizes. In contrast thereto, the method of the invention is more efficient at large particle sizes greater than 6 mm. This ability to work with larger particles yields great savings in effort and expense expended in particle size reduction and classification, i.e., crushing and screening.

Also in conventional high tension separations based on differences in conductivity, the more conductive particles lose their charge more rapidly and are thrown from the roll first while the less conductive particles remain pinned to the roll. In contrast thereto, in the method of the present invention, the vermiculite particles remain pinned to the roll while the gangue particles are released even though the vermiculite particles have a higher conductivity than the gangue particles. This clearly shows that the method of the invention is something other than a conventional high tension separation.

Moreover, the method of the invention is not sensitive to moisture as are conventional electrostatic or high tension separations. Instead of it being necessary to dry the ore to a moisture content of about two percent or less by weight, the method of the invention performs satisfactory separations at moisture levels ranging up to as much as twenty percent by weight. This ability to dispense with drying operations also yields substantial savings in effort and expense.

Further aspects of the invention will be apparent from a consideration of the following examples.

EXAMPLE 1

A sample of coarse vermiculite ore having a particle size distribution between 6 and 18 mm was treated on an electrostatic separator equipped with a 350 mm (14 inch) grounded drum provided with a nonconducting urethane coating. Ore particles on the drum were bombarded with ions from two 22 kilovolt negative D.C. electrodes. The first electrode was disposed at an angle of 60° above the horizontal centerline of the roll and was spaced a distance of 3¼ inches from the roll surface. The second electrode was disposed 30° above the horizontal centerline of the roll and was spaced 2⅞ inches from the roll surface. A splitter was positioned beneath and to the side of the roll spaced 15/16 inches from the roll surface. The roll was rotated at a rate of 10 revolutions per minute, and ore was fed to the roll at a rate of 75 pounds per hour per linear inch of roll length. Results of the test are shown in Table I.

TABLE I

| Material | Weight | | Assay % | | Distribution % | |
|---|---|---|---|---|---|---|
| Fraction | Grams | % | Vermiculite | Gangue | Vermiculite | Gangue |
| Raw Ore | 600 | 100 | 8.8 | 91.2 | 100 | 100 |
| Concentrate | 59 | 9.8 | 79.7 | 20.3 | 88.8 | 2.2 |
| Tailings | 541 | 90.2 | 1.1 | 98.9 | 11.2 | 97.8 |

From the table it can be seen that in a single pass through the separator a concentrate fraction containing nearly 90% of the vermiculite in the original ore sample and assaying almost 80% vermiculite was isolated from an initial ore sample assaying only 8.8% vermiculite. Such results are considered excellent.

EXAMPLE 2

To demonstrate the importance of particle size, a second sample of vermiculite ore having particle size between 3 and 9 mm was passed through a high tension separator as described in Example 1 except that the speed of rotation of the insulated roll was 15 revolutions per minute and the rate at which the ore was fed to the roll varied between 50 and 75 pounds per hour per inch of roll length during the course of the test. Results of the test are shown in Table II.

TABLE II

| Material | Weight | | Assay % | | Distribution % | |
|---|---|---|---|---|---|---|
| Fraction | Grams | % | Vermiculite | Gangue | Vermiculite | Gangue |
| Raw Ore | 408 | 100.0 | 10.5 | 89.5 | 100.0 | 100.0 |
| Concentrate | 57 | 14.0 | 46.5 | 53.5 | 61.7 | 8.4 |
| Tailings | 351 | 86.0 | 4.7 | 95.3 | 38.3 | 91.6 |

From the table it can be seen that although some separation of the vermiculite from the gangue was achieved, nearly 40% of the vermiculite was lost in the tailings and the concentrate fraction contained more gangue than vermiculite.

EXAMPLE 3

A sample of vermiculite ore having a particle size distribution between 6.7 and 25 mm was subjected to a single pass treatment on an electrostatic separator equipped with a 350 mm (14 inch) grounded drum provided with a nonconducting chlorosulfonate polyethylene covering. The ore particles on the drum were bombarded with ions from two 21 kilovolt negative D.C. electrodes. The first electrode was disposed at an angle of 72° above the horizontal centerline of the roll and the second electrode was disposed 50° above the horizontal centerline of the roll. Each of the electrodes was spaced a distance of 1½ inches from the roll surface. A splitter was positioned beneath and to the side of the roll spaced 2 inches from the roll surface. The roll was rotated at a rate of 60 revolutions per minute, and ore was fed to the roll at a rate of 80 pounds per hour per linear inch of roll length. Results of the test are shown in Table III.

TABLE III

| Material | Weight | | Assay % | | Distribution % | |
|---|---|---|---|---|---|---|
| Fraction | Grams | % | Vermiculite | Gangue | Vermiculite | Gangue |
| Raw Ore | 703 | 100 | 12.8 | 87.2 | 100 | 100 |
| Concentrate | 88 | 12 | 94.3 | 5.7 | 92 | 1 |
| Tailings | 615 | 88 | 1.1 | 98.9 | 8 | 99 |

From the table it can be seen that outstanding separation was achieved.

EXAMPLE 4

For comparison purposes a similar sample of vermiculite ore was subjected to a single pass treatment in an electrostatic separator under conditions identical to those utilized in Example 3 except that a conductive steel roll without any insulating coating was utilized in the separator. The results of the test are shown in Table IV.

TABLE IV

| Material | Weight | | Assay % | | Distribution % | |
|---|---|---|---|---|---|---|
| Fraction | Grams | % | Vermiculite | Gangue | Vermiculite | Gangue |
| Raw Ore | 701 | 100 | 13.1 | 86.9 | 100 | 100 |
| Concentrate | 5 | 1 | 80 | 20 | 4 | 1 |
| Tailings | 696 | 99 | 12.6 | 87.4 | 96 | 100 |

From the table it can be seen that practically no separation of vermiculite from the gangue took place.

The foregoing examples have been given merely as illustrations of the present invention and are not to be construed as limiting the scope of the invention. Since modifications of the illustrative examples within the scope and spirit of the present invention are likely to occur to others skilled in the art, the scope of the invention is to be limited solely by the scope of the appended claims.

I claim:

1. A method of treating a particulate ore to separate relatively flat crystalline mineral particles from the associated gangue comprising the steps of:

feeding to a rotating support comprising a grounded, conductive underlayer and a nonconductive overlayer, an ore containing such components and having a moisture content not exceeding about 20% by weight, a minimum particle size of at least about 6 millimeters and a ratio of the average flatness coefficient of the relatively flat particles to that of the remaining particles of at least about 2;

pinning the ore particles to the rotating support by bombarding the particles on the support in a first zone along the path of rotation of the support with ions from at least one ionizing electrode; and collecting a tailings fraction comparatively poor in relatively flat crystalline mineral particles and a product fraction comparatively rich in relatively flat crystalline mineral particles in second and third zones respectively along the path of rotation of the support as the particles separate from the rotating support.

2. A method as recited in claim 1 wherein said crystalline mineral is selected from the group consisting of vermiculite and mica.

3. A method as recited in claim 1 wherein said ionizing electrode is a D.C. corona discharge electrode energized to a potential between about 15 and about 40 kilovolts.

4. A method as recited in claim 3 wherein said corona discharge electrode is energized to a potential between 20 and 35 kilovolts.

5. A method as recited in claim 3 wherein said electrode is energized by an unfiltered, rectified alternating current power supply.

6. A method as recited in claim 1 wherein said rotating support comprises a cylindrical roll from 250 to 1250 mm in diameter rotating at a rate from 2 to 100 r.p.m.

7. A method as recited in claim 6 wherein said roll rotates at a rate from 8 to 50 r.p.m.

8. A method as recited in claim 1 wherein the size of particles in said mixture varies from 6 to 50 mm.

9. A method as recited in claim 8 wherein the size of the particles in the mixture varies from 20 to 50 mm.

10. A method as recited in claim 1 wherein said nonconductive overlayer has a thickness of at least 0.25 mm and a volume resistivity in excess of $10^8$ ohm/cm.

11. A method as recicted in claim 10 wherein said overlayer has a thickness between 1.25 and 4.0 mm and a volume resistivity from $10^{10}$ to $10^{17}$ ohm/cm.

12. A method as recited in claim 10 wherein said nonconductive layer is a sheet or film of an insulating resin.

13. A method as recited in claim 12 wherein said resin is a chloro sulfonate polyethylene.

14. A method as recited in claim 12 wherein said resin is a modified resin incorporating conductive particles.

15. A method as recited in claim 10 wherein said resin is selected from the group consisting of polyurethanes, polyamides, polycarbonates, polyesters, phenolics, natural and synthetic rubbers, unsubsituted and substituted polyolefins.

16. A method as recited in claim 1 wherein the method is repeated for the product fraction to produce a concentrate fraction and a middlings fraction.

17. A method as recited in claim 16 wherein said middlings fraction is recycled to the original feed material.

18. A method as recited in claim 1 further comprising the step of treating the surface of said rotating support to remove residual charges and adhering particles of mineral.

19. A method as recited in claim 18 wherein said treatment to remove adhering particles and residual charges is effected by bombarding the surface of the rotating support with ions from a corona discharge electrode.

20. A method as recited in claim 1 wherein said rotating support is a cylindrical roll rotating about a horizontal axis and said ionizing electrode is located from 50 to 120 mm from the roll surface and between 10 and 80 degrees above the horizontal axis of the roll.

21. A method as recited in claim 1 wherein said rotating support is a cylindrical roll rotating about a horizontal axis and said first and second particle fractions are divided from each other by means of a splitter located from 10 to 50 mm from the roll surface and between 30 and 45 degrees below the horizontal axis of the roll. 30 and 45 degrees below the horizontal axis of the roll.

22. A method as recited in claim 1 wherein the ore particles on said support are bombarded with ions from at least two adjacent ionizing electrodes.

23. A method as recited in claim 1 wherein the ore is fed to said rotating support at a rate of from 10 to 150 lbs. per hour per inch of axial length of the support.

24. A method as recited in claim 23 wherein the feed rate is between 50 and 75 pounds per hour per inch.

25. A method as recited in claim 1 wherein the diameter of the rotating support electrode is at least about 10 times the nominal maximum size of the ore particles.

26. A method as recited in claim 1 wherein the diameter of the rotating support electrode lies in the range from about 20 to about 25 times the nominal maximum size of the ore particles.

27. A method as recited in claim 1 wherein the crystalline mineral has a higher conductivity than the associated gangue.

28. A method as recited in claim 1 wherein the energy consumption is less than one horsepower per ton of ore per hour.

29. A method as recited in claim 1 wherein the ore is moist.

30. A method as recited in claim 29 wherein the moisture content of the ore is in the range from one-half to eight percent by weight.

* * * * *

UNITED STATES PATENT AND TRADEMARK OFFICE

CERTIFICATE OF CORRECTION

PATENT NO. : 4,247,390

DATED : January 27, 1981

INVENTOR(S) : Frank S. Knoll

It is certified that error appears in the above—identified patent and that said Letters Patent is hereby corrected as shown below:

Column 3, line 62, change "am" to —dam—;

Column 4, line 6, change "exclent" to —excellent—;

Column 7, line 11, change "by" to —be—;

Column 7, line 28, change "is" to —it—;

Claim 11, line 1, change "recicted" to —recited—;

Claim 21, lines 6-7, after the period "." on line 6, cancel "30 and 45 degrees below the horizontal axis of the roll."

Signed and Sealed this

*Ninth* Day of *June 1981*

[SEAL]

*Attest:*

RENE D. TEGTMEYER

*Attesting Officer* *Acting Commissioner of Patents and Trademarks*